US005657954A

United States Patent [19]

Emery et al.

[11] Patent Number: 5,657,954

[45] Date of Patent: Aug. 19, 1997

[54] ADJUSTABLE DEVICE FOR SUCTION CUP ADHESION

[75] Inventors: William W. Emery, Berkeley Heights; Russell A. Fritts, Warren, both of N.J.

[73] Assignee: Better Sleep Mfg. Co., Berkeley Heights, N.J.

[21] Appl. No.: 572,661

[22] Filed: Dec. 14, 1995

[51] Int. Cl.[6] ..... A47B 196/06

[52] U.S. Cl. ..... 248/221.12; 248/206.3; 248/222.41

[58] Field of Search ..... 248/221.12, 206.2, 248/206.3, 205.5, 205.7, 222.41, 223.21

[56] References Cited

U.S. PATENT DOCUMENTS

| | | | |
|---|---|---|---|
| 121,813 | 8/1871 | Isenberg . | |
| 251,522 | 4/1881 | Chapman . | |
| 1,325,143 | 12/1919 | Conterio . | |
| 1,531,694 | 3/1925 | Downing | 248/222.41 X |
| 1,694,235 | 12/1928 | Schoenfelder . | |
| 2,044,520 | 6/1936 | Weiant, Jr. . | |
| 3,176,602 | 4/1965 | Wilt | 248/205.5 |
| 3,185,537 | 5/1965 | Wright . | |
| 4,889,141 | 12/1989 | Lindsey . | |
| 4,938,346 | 7/1990 | Urbano . | |
| 5,014,860 | 5/1991 | Emery . | |
| 5,039,046 | 8/1991 | Brewster | 248/206.3 |
| 5,047,102 | 9/1991 | Emery . | |
| 5,289,927 | 3/1994 | Emery | 248/206.3 X |

*Primary Examiner*—Ramon O. Ramirez

*Attorney, Agent, or Firm*—Hopgood, Calimafde, Kalil & Judlowe L.L.P.

[57] ABSTRACT

Disclosed is an improved device for adhesion of suction cup mounted assemblies comprising an adjustable key-hole for inserting and retaining button knob suction cups for improved holding of mounted assemblies to flat surfaces.

3 Claims, 3 Drawing Sheets

ADJUSTABLE DEVICE FOR SUCTION CUP ADHESION

FIELD OF INVENTION

The present invention relates to improvements for adhesion of suction cup mounted assemblies, and more particularly, to an adjustable key-hole lock device for button knob suction cups to improve holding of mounted assemblies on surfaces having partial porous areas.

BACKGROUND OF THE INVENTION

Assemblies for organizing household articles suspended on non-porous surfaces such as tile, glass and walls have evolved over the past decade with increased popularity based on convenience and design choice. For instance, Lindsey Pat. No. 4,889,141 describes a shower kit for holding toiletries, and Urbano Pat. No. 4,938,346 describes a wall-mounted soap dish, both of which are adapted to attach onto non-porous surfaces via suction cups.

Some art-recognized devices are suspended from the shower arm or pipe which extends from the wall of a bath area and are stabilized with suction cups on the lower aspects of the assembly. A representative example is provided in Chapman Design Pat. No. 251,522 which depicts a coated wire frame shower caddy for holding toiletries which is stabilized from side-ways movement with split tunnel suction cups. In such suction cups, the point of attachment to the wire frame is a slit in the rear or "knob" of the suction cup which engages the coated wire, parallel with respect to the plane of the attachment surface.

Another example is provided in Schoenfelder Pat. No. 1,694,235 which describes a coated wire frame soap dish for attaching to a non-porous surface with knob-piercing suction cups. The coated wire frame assembly provides specific arms for penetrating the rear knob of the suction cup perpendicularly with respect to the plane of the attachment surface. The point of attachment is, thus, fixed in accordance with the design of the coated wire frame, and adherence problems may arise if such suction cups are confined to a position overlying porous areas such as grout lines between tiled surfaces.

Weiant Pat. No. 2,044,520 describes a wall-mounted soap dish which is similarly adapted to attach onto non-porous, flat surfaces via suction cups. The suction cups described here are attached to arms which extend from the molded dish, and the point of attachment on the rear knob of such a suction cup is a hole or tunnel which is parallel with respect to the plane of the attachment surface. Here again, the points of attachment are fixed relative to the design of the soap dish and no adjustability is permitted if a porous area on the mounting surface is encountered.

A third type of suction cup is referred to herein as a "button knob" suction cup. Such suction cups do not require holes or tunnels in the rear knobs for attachment and examples are described in Isenberg Design Pat. No. 121,813, Wright Pat. No. 3,185,537 and Brewster Pat. No. 5,039,046. Essentially, all three patents show assemblies for vertical suspension from flat, non-porous surfaces via button knob suction cups. These cups have a frontal aspect having the suction portion for adhering to a flat surface and a rear portion comprised of a knob onto which is suspended the weight of the holding assembly.

More specifically, Isenberg discloses a coated wire frame soap dish which is adapted to be suspended from button knobs of suction cups which are inserted between adjacent, parallel coated wires and held in place by the bias provided between the parallel wires. Wright shows a molded soap holder having punched holes in the rear walls through which the knobs are inserted, followed by mounting of the suction cups to a non-porous surface wall. The weight of the soap holder is suspended from the punched, non-adjustable holes. Brewster teaches a coated wire, baby bottle holder which have loops formed in the superior aspects of the wire frame for suspending the assembly from button knobs of suction cups.

None of these references teach an assembly which permits an adjustable attachment of a suction cup to avoid porous areas of an attachment surface. The problems associated with adherence of suction cups to porous surface areas are particularly pronounced with corner brackets. For example, Conteiro Pat. No. 1,325,143 describes a corner mounted, shower bracket for holding bath articles. The Conteiro corner bracket is held by non-adjustable, rubber suction cups. If by chance a particular shower stall has grout lines and tiles which conform perfectly with the fixed position of the suction cups, with no areas of porous grout coming under the cups, the corner assembly will stay mounted. However, as is usually the case, porous grout lines do not conform well with fixed assembly designs and attempts at such suction cup attachment are weak if not a total failure.

Emery Pat. Nos. 5,014,860 and 5,289,927 teach coated wire corner shower caddies and address some of the problems existing in the art associated with suction cups and attachment surfaces having partial porous areas. The Emery patents disclose suction cups each having a tunnel in the rear Knob which is parallel with respect to the plane of the attachment surface. Horizontal portions of the wire frame are inserted into the tunnels on the rear knob of the suction cups and the cups can then slide horizontally along the wire frame for adjustment to avoid porous, grouted areas.

Despite such known improvements, a need yet exists in the art for overcoming the shortcomings and drawbacks of prior art designs which do not allow adjustability for their suction cups especially when the assembly to be suspended is not of a coated wire construction such as shown in Emery Pat. Nos. 5,014,860 and 5,289,927.

Accordingly, it is an object of the present invention to provide a key-hole lock device for adjustably holding button knob suction cups for suspending assemblies from flat surfaces.

Another object of the present invention is to provide a key-hole lock device for adjustably holding button knob suction cups for suspending assemblies from flat surfaces having a combination of porous and non-porous areas.

These and other objects will become apparent from the disclosure provided hereinbelow.

SUMMARY OF THE INVENTION

The present invention includes a key-hole lock device for adjustably holding button knob suction cups for suspending assemblies from flat surfaces, comprising at least two key-hole edges, each of the key-hole edges comprised of a substantially circular edge portion and an elongated edge portion, the substantially circular edge portion adapted to insert a button knob of a suction cup and the elongated edge portion adapted to adjustably position the button knob for adjustment of the suction cup to adhere to non-porous portions of the flat surfaces.

Also disclosed is a locking rib for backing the button knob in bias when the button knob has to be within the circular edge portion to avoid porous portions of the flat surfaces.

The locking rib also prevents the knob from inadvertently exiting the circular edge portion.

In another embodiment, the key-hole lock device comprises at least one key-hole edge which is further comprised of an arc edge portion and at least one elongated edge portion. The arc edge portion is adapted to insert a button knob of a suction cup and the elongated edge portion is adapted to adjustably position the button knob for adjustment of the suction cup to adhere to non-porous portions of flat surfaces. This embodiment also has a locking rib for stopping the button knob in bias when the button knob has to be within the arc edge portion to avoid porous portions of flat mounting surfaces. As before, the locking rib also prevents the knob from inadvertently exiting from the arc edge portion.

In a further embodiment, the key-hole lock device comprises at least one key-hole edge comprised of a substantially circular edge portion and an elongated edge portion, the substantially circular edge portion is adapted to insert a button knob of a suction cup and the elongated edge portion is adapted to adjustably position the button knob for adjustment of the suction cup to adhere to non-porous portions of the flat surfaces. In this embodiment too, a locking rib backs the button knob in bias when the button knob has to be within the circular edge portion to avoid porous portions of the flat surfaces. The locking rib also prevents the knob from inadvertently exiting the circular edge portion.

BRIEF DESCRIPTION OF THE DRAWINGS

For a more complete understanding of this invention, reference is made to the following detailed description of the illustrated embodiments in connection with the accompanying drawings.

DETAILED DESCRIPTION OF THE ILLUSTRATED EMBODIMENTS

Figure 1:
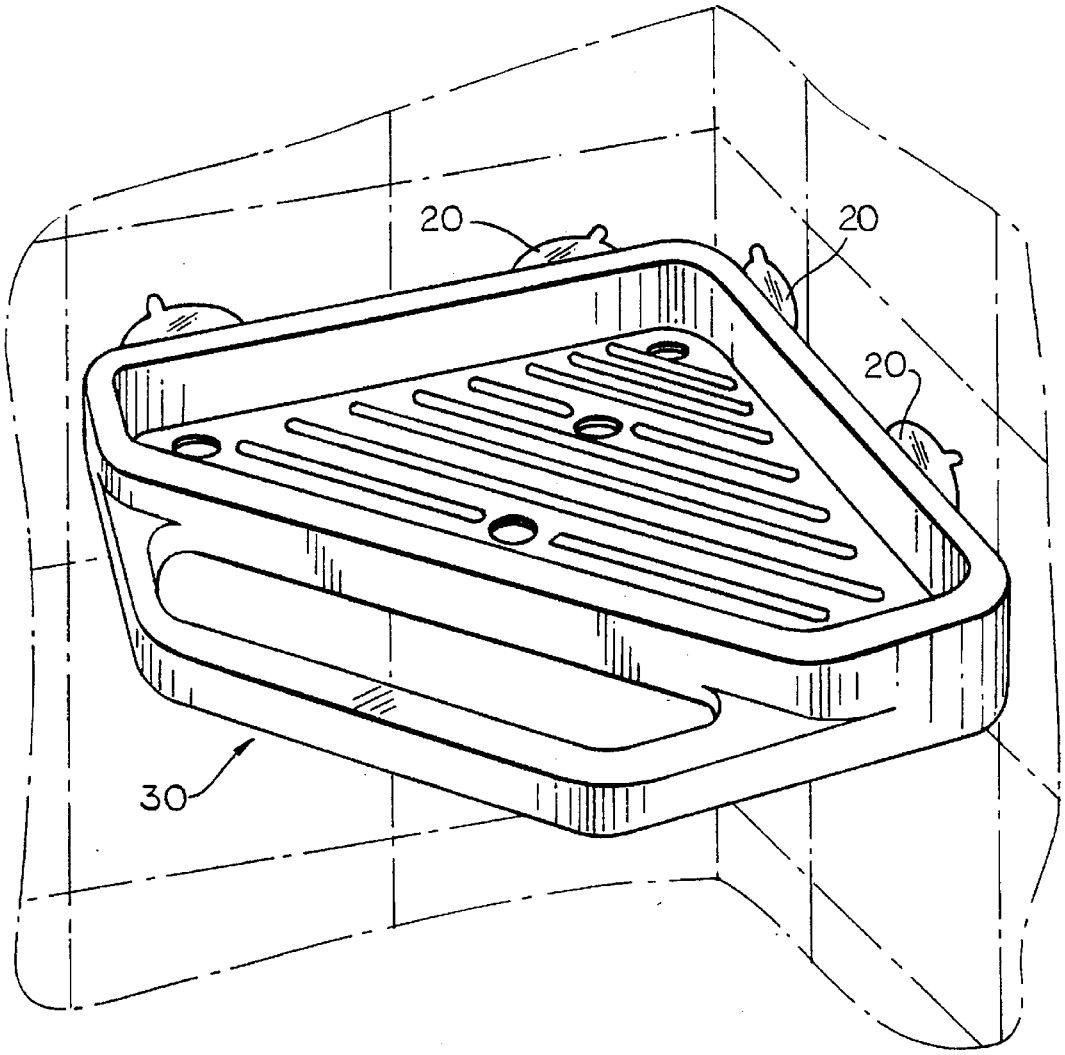
FIG. 1 is a perspective view of a preferred operation for the present invention.

The present invention will now be described in connection with the figures. FIG. 1 depicts the present invention in operation, and shows exemplary corner, shower bracket 30 held between two corner walls of a shower stall (drawn in phantom lines). The phantom lines also depict the lines of porous grout areas. Suction cups 20, 20' and 20" adhere well to non-porous tiled surfaces, but do not attach onto porous areas such as the grout lines. FIG. 1 shows suction cups 20, 20' and 20" attachably disposed along the walls of the shower stall and avoiding the porous grout lines.

Figure 2:
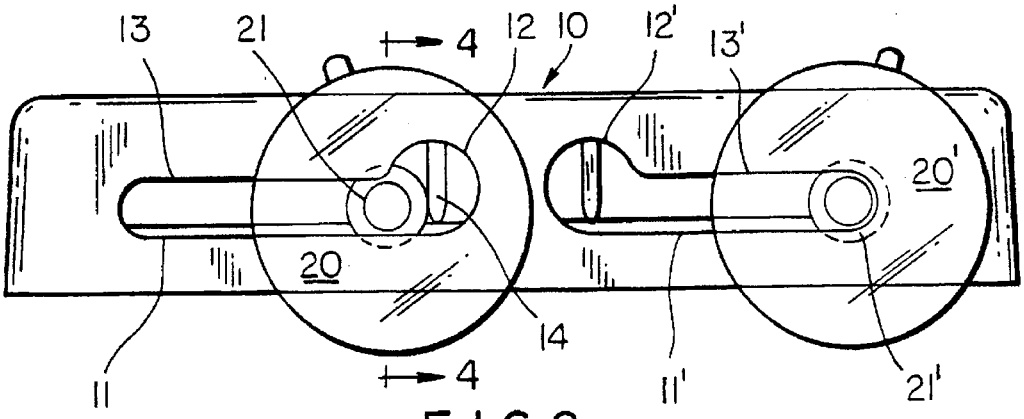
FIG. 2 shows clear button knob suction cups through which is seen portions of the preferred key-hole lock device from a frontal perspective, and before the suction cups are attached to a surface.

FIG. 2 is a frontal view of the preferred key-hole lock device 10. Portions of the key-hole are seen through clear button knob suction cups 20 and 20'. FIG. 2 shows key-hole lock device 10 as comprised of at least two key-hole edges 11 and 11'. Key-hole edge 11' is depicted as having a substantially circular edge portion 12', and an elongated edge portion 13'; and key-hole edge 11 is depicted as having a substantially circular edge portion 12 and an elongated edge portion 13.

Figure 3:
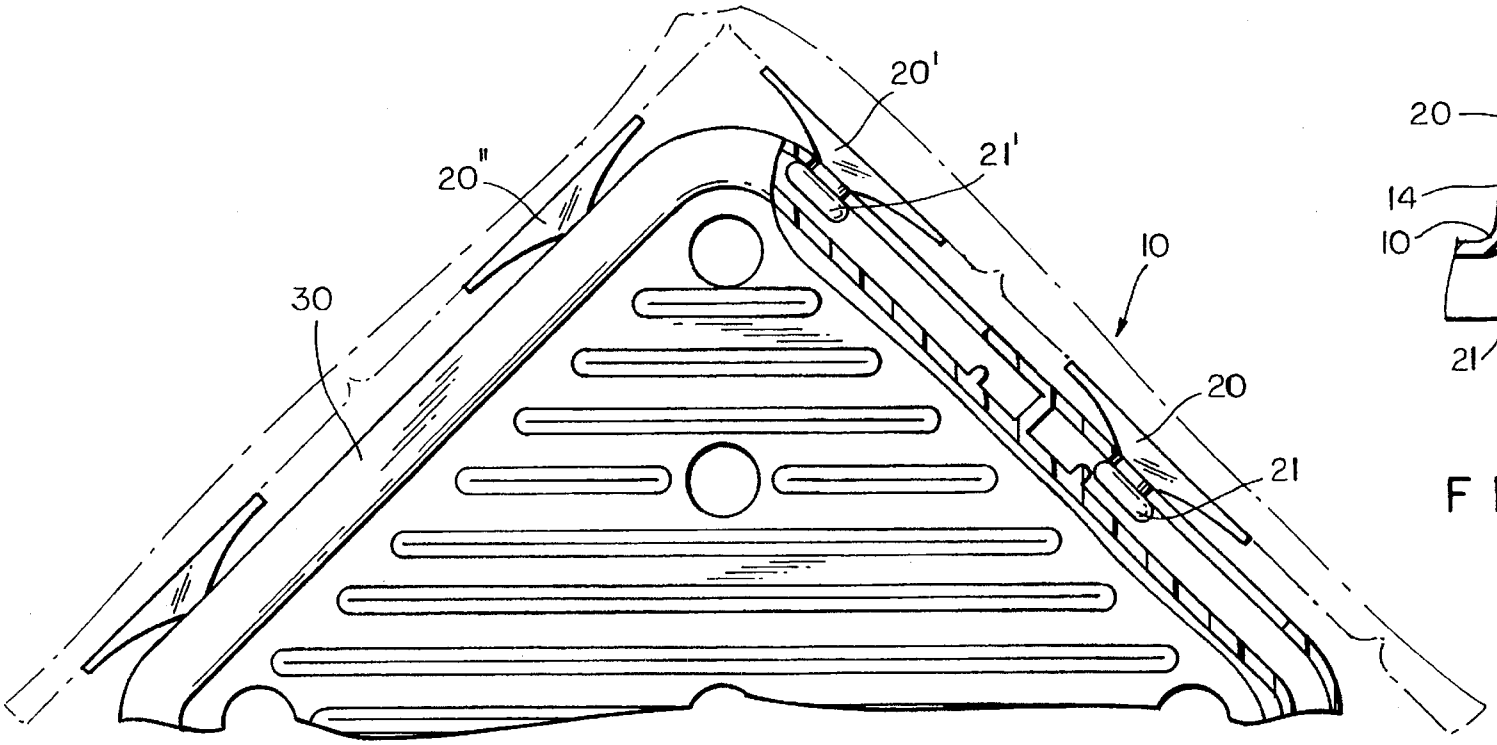
FIG. 3 is a bird's eye view of the preferred key-hole lock device with a partial cut-away view into one section of the associated corner bracket.

Representative suction cup 20 is a button knob suction cup having knob 21 (shown in FIG. 2 in phantom lines). FIG. 3 is the bird's eye view of the preferred key-hole lock device 10 with a partial cut-away view into a relevant section of corner bracket 30. Button knobs 21 and 21' are shown inserted into key-hole lock device 10.

In use, and referring back to FIG. 2, button knob 21 of suction cup 20 is inserted into substantially circular edge portion 12 of key-hole edge 11. Once inserted, button knob 21 of suction cup 20 is horizontally adjusted within elongated edge portion 13 so that the suction cup is positioned along elongated edge portion 13 for proper adhesion to only non-porous portions of the surface of (by way of example) a shower stall. Button knob 21' of suction cup 20' is similarly inserted into substantially circular edge portion 12' of key-hole edge 11' and suitably adjusted.

Figure 4:
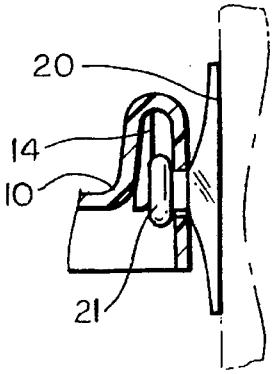
FIG. 4 is a cut-away view taken from section lines 4—4 in FIG. 2, and shows backing means in the form of a rib holding in bias button knob of a suction cup.

FIG. 4 illustrates a cut-away view taken from lines 4—4 in FIG. 2, and shows backing means in the form of locking rib 14 holding in bias button knob 21 of suction cup 20 within key-hole lock device 10. Viewed in conjunction with FIG. 2, if button knob 21 of suction cup 20 is not horizontally adjusted within elongated edge portion 13 because button knob 21 has to be substantially within circular edge portion 12 for suction cup 20 to avoid a porous portion of the adherence surface, locking rib 14 is able to provide sufficient bias to hold knob 21 for holding bracket 10. Locking rib 14 also prevents knob 21 from inadvertently exiting circular edge portion 12.

Figure 5:
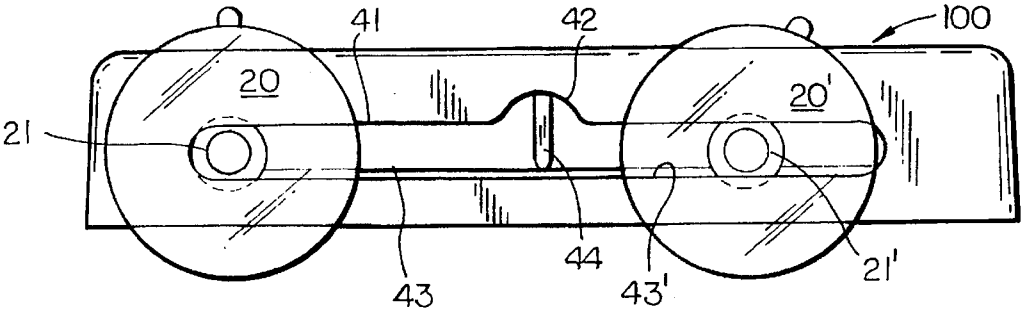
FIG. 5 shows clear button knob suction cups through which is seen another embodiment of the key-hole lock device from a frontal perspective.

FIG. 5 shows clear button knob suction cups 20 and 20' through which is seen another embodiment of the key-hole lock device 100 from a frontal perspective. Portions of alternate embodiment key-hole lock device 100 are seen through clear button knob suction cups 20 and 20'. FIG. 5 shows key-hole lock device 100 as comprised of at least one key-hole edge 41. Key-hole edge 41 is depicted as having a centralized arc edge portion 42 and elongated edge portions 43 and 43' on either side of arc edge portion 42.

The embodiment shown in FIG. 5 also has a locking rib 44 for stopping either button knob 21 or 21' in bias when either of these button knobs has to be within arc edge portion 42 to avoid porous portions of flat mounting surfaces. Locking rib 44 also prevents either knob 21 or 21' from inadvertently exiting from arc edge portion 42.

In use, button knob 21 of suction cup 20 is inserted into arc edge portion 42 of key-hole edge 41. Once inserted, button knob 21 of suction cup 20 is horizontally adjusted within elongated edge portion 43 so that the suction cup is positioned along elongated edge portion 43 for proper adhesion to non-porous portions of the adhering surface. Button knob 21' of suction cup 20' is similarly inserted into arc edge portion 42 of key-hole edge 41 and suitably adjusted.

Figure 6:
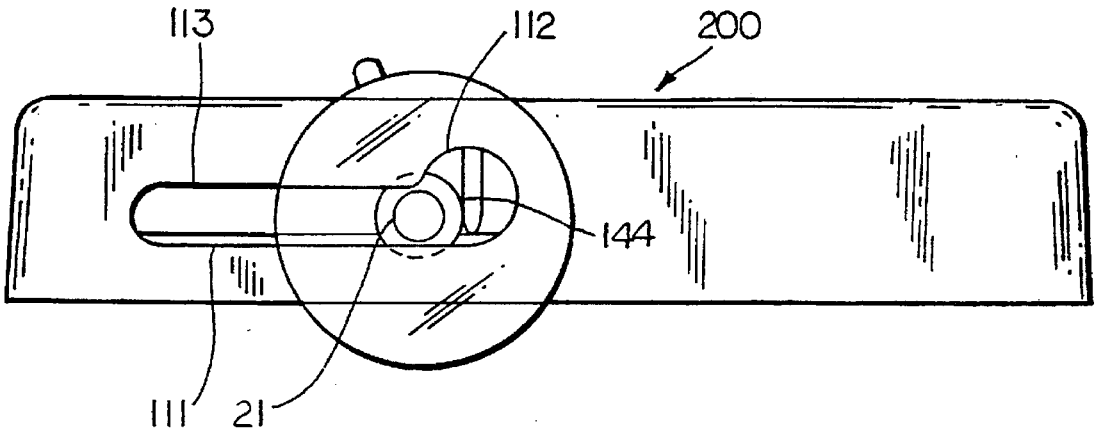
FIG. 6 is a further embodiment of the key-hole lock device from a frontal perspective showing one key-hole edge comprised of a substantially circular edge portion and an elongated edge portion.

Another embodiment is depicted in FIG. 6. In this embodiment, key-hole lock device 200 comprises at least one key-hole edge 111. Key-hole edge 111 is depicted as having a substantially circular edge portion 112 and an elongated edge portion 113. The embodiment shown in FIG.

6 also has a locking rib 144 for stopping button knob 21 in bias when the button knob has to be within circular edge portion 112 to avoid porous portions of flat mounting surfaces. Locking rib 144 also prevents knob 21 from inadvertently exiting from circular edge portion 112.

The illustrated embodiments have proven to be useful in many applications for this art. Further modifications based on the disclosure will occur to persons skilled in the art. These modifications are within the scope and spirit of the present invention as defined by the following claims.

What is claimed is:

1. A key-hole lock device for adjustably holding button knob suction cups for suspending assemblies from flat surfaces, comprising:

at least two key-hole edges, each of said key-hole edges comprised of a substantially circular edge portion and an elongated edge portion, said substantially circular edge portion adapted to insert a button knob of a suction cup and said elongated edge portion adapted to adjustably position said button knob for adjustment of said suction cup to adhere to non-porous portions of said flat surfaces; and a locking rib for backing said button knob in bias when said button knob is substantially within said circular edge portion to avoid porous portions of said flat surfaces.

2. A key-hole lock device for adjustably holding button knob suction cups for suspending assemblies from flat surfaces, comprising:

at least one key-hole edge, said key-hole edge comprised of an arc edge portion and at least one elongated edge portion, said arc edge portion adapted to insert a button knob of a suction cup and said elongated edge portion adapted to adjustably position said button knob for adjustment of said suction cup to adhere to non-porous portions of said flat surfaces; and a locking rib for backing said button knob in bias when said button knob is substantially within said arc edge portion to avoid porous portions of said flat surfaces.

3. A key-hole lock device for adjustably holding button knob suction cups for suspending assemblies from flat surfaces, comprising:

at least one key-hole edge, said key-hole edge comprised of a substantially circular edge portion and an elongated edge portion, said substantially circular edge portion adapted to insert a button knob of a suction cup and said elongated edge portion adapted to adjustably position said button knob for adjustment of said suction cup to adhere to non-porous portions of said flat surfaces; and a locking rib for backing said button knob in bias when said button knob is substantially within said circular edge portion to avoid porous portions of said flat surfaces.

* * * * *